US009112335B2

(12) United States Patent
Kenworthy

(10) Patent No.: US 9,112,335 B2
(45) Date of Patent: Aug. 18, 2015

(54) SPARK PLUG AND SPARK PLUG ELECTRODE

(71) Applicant: Unison Industries, LLC, Jacksonville, FL (US)

(72) Inventor: Michael Thomas Kenworthy, Jacksonville, FL (US)

(73) Assignee: Unison Industries, LLC, Jacksonville, FL (US)

( * ) Notice: Subject to any disclaimer, the term of this patent is extended or adjusted under 35 U.S.C. 154(b) by 100 days.

(21) Appl. No.: 14/012,370

(22) Filed: Aug. 28, 2013

(65) Prior Publication Data

US 2015/0061486 A1 Mar. 5, 2015

(51) Int. Cl.

| | |
|---|---|
| ***H01T 13/20*** | (2006.01) |
| ***H01T 13/39*** | (2006.01) |
| ***C22C 28/00*** | (2006.01) |

(52) U.S. Cl.

CPC ..... *H01T 13/39* (2013.01); *C22C 28/00* (2013.01)

(58) Field of Classification Search

CPC ..... H01T 13/39; C22C 5/04
USPC ..... 313/141
See application file for complete search history.

(56) References Cited

U.S. PATENT DOCUMENTS

| | | | |
|---|---|---|---|
| 4,324,588 | A | 4/1982 | Zysk et al. |
| 4,742,265 | A | 5/1988 | Giachino et al. |
| 5,998,913 | A | 12/1999 | Matsutani |
| 6,071,163 | A | 6/2000 | Chang et al. |
| 6,412,465 | B1 | 7/2002 | Lykowski et al. |
| 6,885,136 | B2 | 4/2005 | Orjela et al. |
| 7,145,287 | B2 | 12/2006 | Kato |
| 7,449,823 | B2 | 11/2008 | Menken et al. |
| 8,030,830 | B2 | 10/2011 | Passman et al. |
| 8,274,203 | B2 | 9/2012 | Ma et al. |
| 2007/0194681 | A1 | 8/2007 | Yoshida |
| 2009/0127996 | A1 | 5/2009 | Passman et al. |
| 2011/0121713 | A1 | 5/2011 | Ma |
| 2012/0169206 | A1 | 7/2012 | Ma |

OTHER PUBLICATIONS

Cranstoun, G., & Pyke, D. (1979). The oxidation of clean ruthenium surfaces. Applications of Surface Science, 359-374.

Cao, F., Nandy, T. K., Stobbe, D., & Pollock, T. M. (2007). Oxidation of ruthenium aluminide-based alloys: The role of microstructure and platinum additions. Intermetallics, 15(1), 34-43.

I. Wolff, "New applications for ruthenium," South African Journal of Science, vol. 95, pp. 539-542, Nov./Dec. 1999.

*Primary Examiner* — Vip Patel

(74) *Attorney, Agent, or Firm* — General Electric Company; William S. Munnerlyn

(57) ABSTRACT

A spark plug having a shell defining a cavity, an insulator disposed within the cavity, and an electrode at least partially encapsulated by the insulator. The electrode may be formed from a ruthenium (Ru) electrode material having a columnar grain structure. Further, the ruthenium (Ru) electrode material may have a purity greater than 99.90 wt. percentage.

13 Claims, 4 Drawing Sheets

SPARK PLUG AND SPARK PLUG ELECTRODE

BACKGROUND OF THE INVENTION

Contemporary engines including automotive and aviation engines include spark plugs to facilitate engine starting and/or running. Typically, a high-energy spark discharge occurs between a center electrode and a ground (shell) electrode to initiate combustion.

BRIEF DESCRIPTION OF THE INVENTION

In one aspect, an embodiment of the invention relates to a spark plug having a shell defining a cavity, an insulator disposed within the cavity, and an electrode at least partially encapsulated by the insulator and formed from a ruthenium (Ru) electrode material having a columnar grain structure.

In another aspect, an embodiment of the invention relates to a spark plug electrode including an electrode material having a columnar grain structure and formed from high purity ruthenium (Ru) having a purity greater than 99.90 wt. percentage.

DESCRIPTION OF EMBODIMENTS OF THE INVENTION

Figure 1:
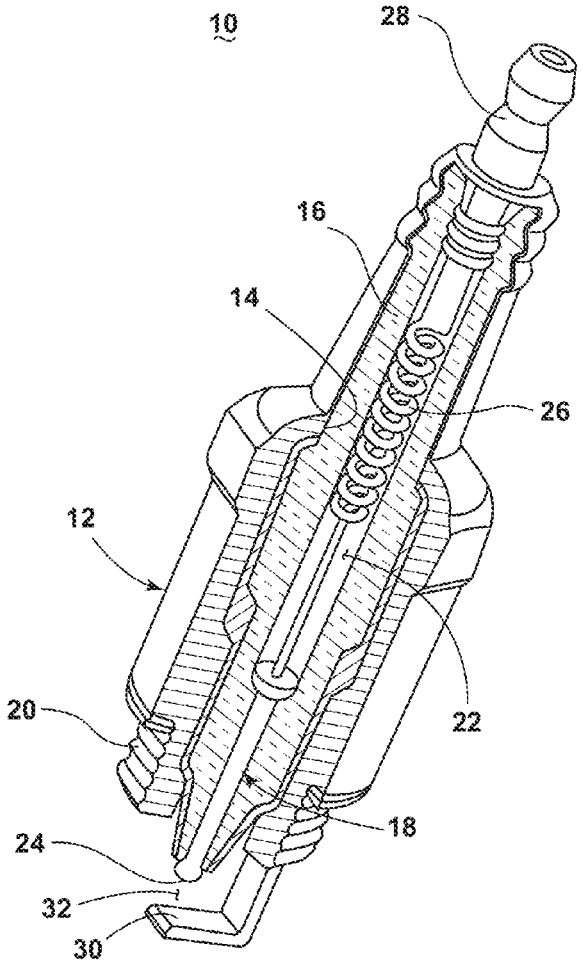
FIG. 1 is a perspective view of a spark plug according to an embodiment of the invention.

FIG. 1 schematically depicts a spark plug 10 having a shell 12, defining a cavity 14, an insulator 16, and an electrode 18. Half of the spark plug 10 has been cut away to better show interior portions of the spark plug 10. The shell 12 may be any suitable shell of any shape and material, including a cylindrical metal shell. The shell 12 may include threads 20 formed on a portion of its surface and such threads 20 may be used for operably coupling the spark plug 10 with a portion of an engine. While not illustrated, the shell 12 may include a shell assembly made of various pieces.

An insulator 16 may be disposed within the cavity 14. The insulator 16 may be inserted into the shell 12 such that portions of the insulator 16 may project from the shell 12. In this manner, the shell 12 at least partially encloses the insulator 16 and the shell 12 may be electrically isolated from the electrode 18 by the insulator 16. The insulator 16 may be formed from any suitable insulating material including ceramic materials. The insulator 16 may include a hollow portion 22 formed therein. Further, while not shown, multiple insulators be inserted into the shell 12.

Figure 4:
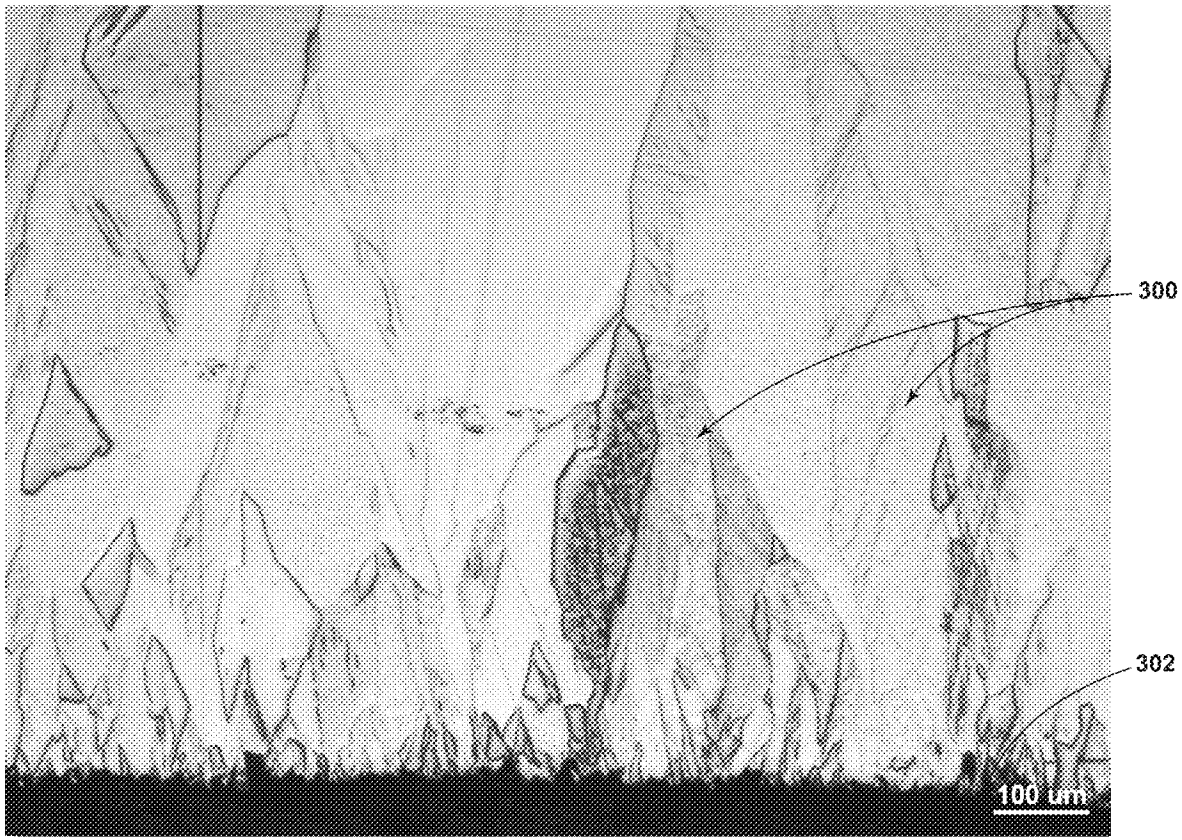
FIG. 4 is a photograph of columnar grain structures in a Ruthenium material according to embodiments of the invention.

The electrode 18 may be located within the hollow portion 22 such that it is at least partially encapsulated by the insulator 16. As illustrated, the electrode 18 may be a center electrode or central electrode. A tip 24 of the electrode 18 may form a spark discharge portion. The electrode 18 will be formed from a ruthenium (Ru) electrode material having a primarily columnar grain structure 300 (FIG. 4). The electrode material having a columnar grain structure may be formed from high purity Ru having a purity greater than 99.90 wt. percentage. For example, the Ru may have a purity greater than 99.95 wt. percentage including that the Ru may have a purity greater than 99.990 wt. percentage and greater than 99.9995 wt. percentage.

The electrode 18 may be coupled to an internal conductor 26, which may include a wire, which is in turn operably coupled to a terminal 28. The terminal 28 may be connected to the ignition system. The exact construction of the terminal 28 may vary depending on the use of the spark plug 10. Further, one or more ground electrodes 30 may be coupled to the shell 12 and spaced from the tip 24 of the electrode 18 to form a spark gap 32. The ground electrode 30 may be formed from any suitable material and coupled to the shell 12 in any suitable manner. For example, in the illustrated example, the ground electrode 18 may be made from high nickel steel and may be welded or hot forged to the side of the shell 12.

It will be understood that the spark plug 10 may be used in various types of engines including that the spark plug 10 may be a turbine igniter for use in aviation. The primary differences between aerospace turbine igniters and reciprocating internal combustion engine spark plugs are largely matters of degree. Aerospace systems are universally higher energy due to the need to ignite less combustible fuel-air mixtures. Igniters also tend to experience higher continuous service temperatures and more severe vibratory environments. A key difference is that the igniter tip exposure to the high temperature oxidizing environment occurs subsequent to operation and over a relatively long period, while spark plugs operate in an environment which cycles at a high frequency. Ambient pressure during igniter sparking may also be higher and, when coupled with higher energies, these conditions can rapidly degrade conventional electrode materials. Thus, it will also be understood that the electrode formed from Ru and having a well-defined columnar grain structure including those having a purity greater than 99.90 wt. percentage may be utilized in a wide variation of spark plug designs, including aviation igniters, which may provide better ignition, longer life, etc.

Figure 2:
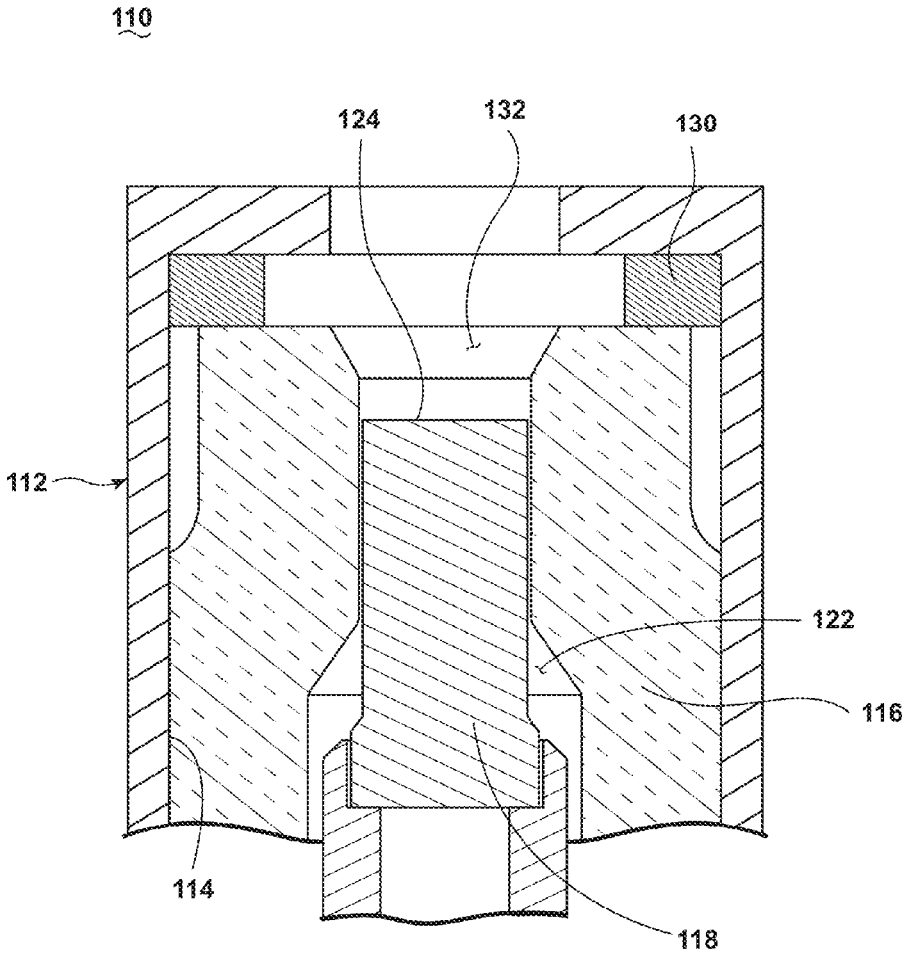
FIG. 2 is a schematic view of a portion of an alternative spark plug.

For example, FIG. 2 schematically illustrates an alternative spark plug 110, which is similar to the spark plug 10 previously described and therefore, like parts will be identified with like numerals increased by 100, with it being understood that the description of the like parts of the spark plug 10 applies to the spark plug 110, unless otherwise noted. One difference is that the spark plug 110 does not include a ground electrode coming from a side of the shell. Instead, the ground electrode 130 is in the shape of a ring and is located within the shell 112. The spark gap 132 may be formed between any portion of the ring ground electrode 130 and the tip 124 of the electrode 118.

Figure 3:
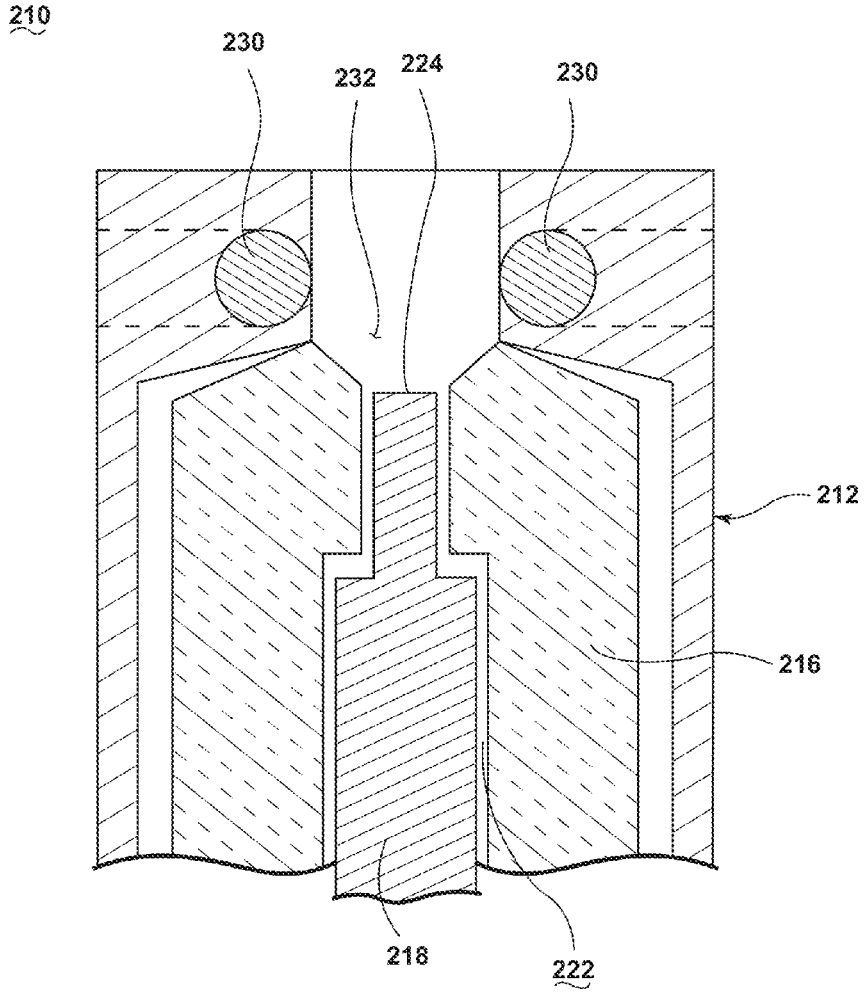
FIG. 3 is a schematic view of a portion of another alternative spark plug.

Further, FIG. 3 illustrates an alternative spark plug 210. The spark plug 210 is similar to the spark plug 10 and the spark plug 110 previously described and therefore, like parts will be identified with like numerals increased by 100, with it being understood that the description of the like parts of the spark plug 10 and the spark plug 110 applies to the spark plug 210, unless otherwise noted. One difference is that multiple ground electrodes 230 in the form of pins have been included inside the shell 212. It will be understood that any number of ground electrodes 230 may be included and may be equally spaced surrounding the electrode 218. Multiple ground electrodes 230 may aid in providing a longer life, as when the spark gap 232 widens due to electric discharge wear, the spark moves to another closer ground electrode 230.

Any of the above described spark plugs may be an igniter for an aviation engine. Further, any of the above electrodes may include an electrode formed from a Ru electrode material having a columnar grain structure, that is grains with aspect ratios greater than 3:1, and may be formed from high purity Ru having a purity greater than 99.90 wt. percentage. FIG. 4 illustrates an electrode material formed from Ru having a well-defined columnar grain structure 300. In FIG. 4, the dark region (region) is depicting a substrate upon which the material is deposited with progressive elongation and increasing grain size moving outward (left). Depending on the required geometry, thermal processing to refine the grain structure may be necessary for enhanced performance as a sparking electrode material, but the primarily columnar structure throughout is maintained. In the illustrated example, the ruthenium electrode material has a purity greater than 99.90 wt. percentage, including that the purity is greater than 99.9995 wt. percentage.

It will be understood that the electrode formed from the Ru having a columnar grain structure 300 may be formed in any suitable manner. For example, the electrode may be grown through electrodeposition and ground to a proper shape. Alternatively, the electrode may include a core and the electrode material may include a Ru layer on the core. In this manner, the Ru layer may be electroformed on the core. Regardless of whether the Ru electrode material is grown or formed on a core, finer grains 302 may be formed where the Ru meets the core, mandrel, etc. Alternatively, Ru having a columnar grain structure may be manufactured using traditional machining techniques such as centerless grinding; however, such techniques may be cost prohibitive.

The above described embodiments provide a variety of benefits including that the columnar grain structure of the electrode enhances performance of the spark plug by reducing rates of erosion and extending the life of the spark plug. It has been determined that as compared to spark plugs using iridium, a spark plug having the above described Ru electrode has a greater than three times life improvement. Further, it has been determined that as compared to spark plugs having an Ru electrode with equiaxed grain structure a spark plug having the above described Ru electrode has almost a two times life improvement. Further, the above described embodiments may have a purity greater than 99.90 wt. percentage, which results in less contaminants that may reduce the performance of the spark plug. Furthermore, the use of the Ru material allows for a cost savings as compared to igniters using iridium and other precious materials. While the Ru is more difficult to work with compared to iridium as it may require grinding to generate features, it is still lower cost overall. By using electrodeposited or electroformed Ru, electrode geometries may be much more cheaply manufactured and used in the spark plug or igniter body. For example, cost savings of 25-30% are estimated for typical Ir-based igniters or spark plugs.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A spark plug, comprising:

a shell defining a cavity;

an insulator disposed within the cavity; and an electrode at least partially encapsulated by an insulator and formed from a ruthenium (Ru) electrode material having a columnar grain structure, wherein the Ru electrode material has a purity greater than 99.90 weight percentage.

2. The spark plug of claim 1 wherein the Ru has a purity greater than 99.990 weight percentage.

3. The spark plug of claim 1 wherein the Ru has a purity greater than 99.9995 weight percentage.

4. The spark plug of claim 1 wherein the spark plug is a turbine igniter.

5. The spark plug of claim 1 wherein the electrode comprises a core and a Ru layer on the core.

6. The spark plug of claim 5 wherein the Ru layer is electroformed on the core.

7. The spark plug of claim 1 wherein the electrode is a center electrode.

8. The spark plug of claim 1, further comprising a terminal that may be selectively operably coupled to an ignition system.

9. The spark plug of claim 8, further comprising an internal conductor coupling the terminal to the electrode.

10. The spark plug of claim 1, further comprising a ground electrode coupled to the shell and spaced from the electrode.

11. A spark plug electrode, comprising:

an electrode material having a columnar grain structure and formed from high purity ruthenium (Ru) having a purity greater than 99.90 weight percentage.

12. The spark plug electrode of claim 11 wherein the Ru has a purity greater than 99.990 weight percentage.

13. The spark plug electrode of claim 11 wherein the Ru has a purity greater than 99.9995 weight percentage.

* * * * *